US009743198B2

(12) United States Patent
Bergner et al.

(10) Patent No.: US 9,743,198 B2
(45) Date of Patent: Aug. 22, 2017

(54) SYSTEMS AND METHODS FOR HEARING ASSISTANCE DEVICE ANTENNA

(71) Applicant: Starkey Laboratories, Inc., Eden Prairie, MN (US)

(72) Inventors: Thomas Blaise Bergner, Chaska, MN (US); Jay Rabel, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 108 days.

(21) Appl. No.: 14/594,564

(22) Filed: Jan. 12, 2015

(65) Prior Publication Data

US 2015/0201288 A1 Jul. 16, 2015

Related U.S. Application Data

(60) Provisional application No. 61/927,685, filed on Jan. 15, 2014.

(51) Int. Cl.
*H04R 25/00* (2006.01)

(52) U.S. Cl.
CPC ..... *H04R 25/554* (2013.01); *H04R 25/608* (2013.01); *H04R 2225/021* (2013.01); *H04R 2225/025* (2013.01); *H04R 2225/51* (2013.01)

(58) Field of Classification Search
CPC ..... H04R 25/554; H04R 2225/51; H04R 2225/021; H04R 25/556; H04R 25/608
(Continued)

(56) References Cited

U.S. PATENT DOCUMENTS 8,180,080 B2 5/2012 Polinske
8,565,457 B2 * 10/2013 Polinske ..... H04R 25/554 381/312
(Continued)

FOREIGN PATENT DOCUMENTS

EP 1594187 A1 11/2005
EP 2200120 A2 6/2010
(Continued)

OTHER PUBLICATIONS

"European Application Serial No. 15151349.6, Extended European Search Report mailed Jun. 5, 2015", 8 pgs.
(Continued)

*Primary Examiner* — Davetta W Goins
*Assistant Examiner* — Phylesha Dabney
(74) *Attorney, Agent, or Firm* — Schwegman Lundberg & Woessner, P.A.

(57) ABSTRACT

Disclosed herein, among other things, are systems and methods for modular circuit component for a hearing assistance device flex antenna. One aspect of the present subject matter includes a universal apparatus for use with multiple hearing assistance devices. The apparatus includes a circuit module including an outer radial surface, the circuit module configured to provide electronics for a hearing assistance device. A flex circuit loop antenna is configured to be affixed to the outer radial surface, and the antenna is configured for wireless communication for the hearing assistance device. After the antenna is affixed to the outer radial surface, the circuit module is configured to be inserted into a plurality of different main hearing assistance device chassis. In various embodiments, the circuit module includes a retention feature and the antenna includes an opening configured to align with and receive the retention feature to affix the antenna to the circuit module.

16 Claims, 5 Drawing Sheets

(58) Field of Classification Search
USPC ..... 381/323, 324, 315
See application file for complete search history.

(56) References Cited

U.S. PATENT DOCUMENTS

| | | | | |
|---|---|---|---|---|
| 8,699,733 | B2 * | 4/2014 | Polinske | H01Q 1/243 381/312 |
| 8,737,658 | B2 * | 5/2014 | Helgeson | H04R 25/602 381/323 |
| 9,167,360 | B2 * | 10/2015 | Polinske | H01Q 1/243 |
| 9,451,371 | B2 * | 9/2016 | Polinske | H01Q 1/22 |
| 9,602,934 | B2 * | 3/2017 | Polinske | H04R 25/554 |
| 2007/0080889 | A1 | 4/2007 | Zhang | |
| 2008/0272980 | A1 | 11/2008 | Adel et al. | |
| 2010/0158293 | A1 * | 6/2010 | Polinske | H01Q 1/243 381/315 |
| 2010/0158294 | A1 | 6/2010 | Helgeson et al. | |
| 2010/0158295 | A1 * | 6/2010 | Polinske | H01Q 1/243 381/323 |
| 2011/0068985 | A1 | 3/2011 | Hillersborg | |
| 2014/0321685 | A1 * | 10/2014 | Rabel | H01Q 1/273 381/324 |
| 2015/0036854 | A1 * | 2/2015 | Polinske | H01Q 7/00 381/315 |
| 2015/0281859 | A1 * | 10/2015 | Fischer | H01Q 1/273 381/315 |
| 2015/0296312 | A1 * | 10/2015 | Nikles | H01Q 1/273 381/315 |

FOREIGN PATENT DOCUMENTS

| | | | |
|---|---|---|---|
| EP | 2257079 | B1 | 1/2012 |
| EP | 2663097 | A1 | 11/2013 |
| WO | WO-0205590 | A1 | 1/2002 |

OTHER PUBLICATIONS

"European Application Serial No. 15151349.6, Communication Pursuant to Article 94(3) EPC mailed Apr. 4, 2016", 8 pgs.
"European Application Serial No. 15151349.6, Office Action mailed Jul. 27, 2015", 2 pgs.
"European Application Serial No. 15151349.6, Response filed Jan. 21, 2016 to Office Action mailed Jul. 27, 2015", 9 pgs.

* cited by examiner

FIG. 5A
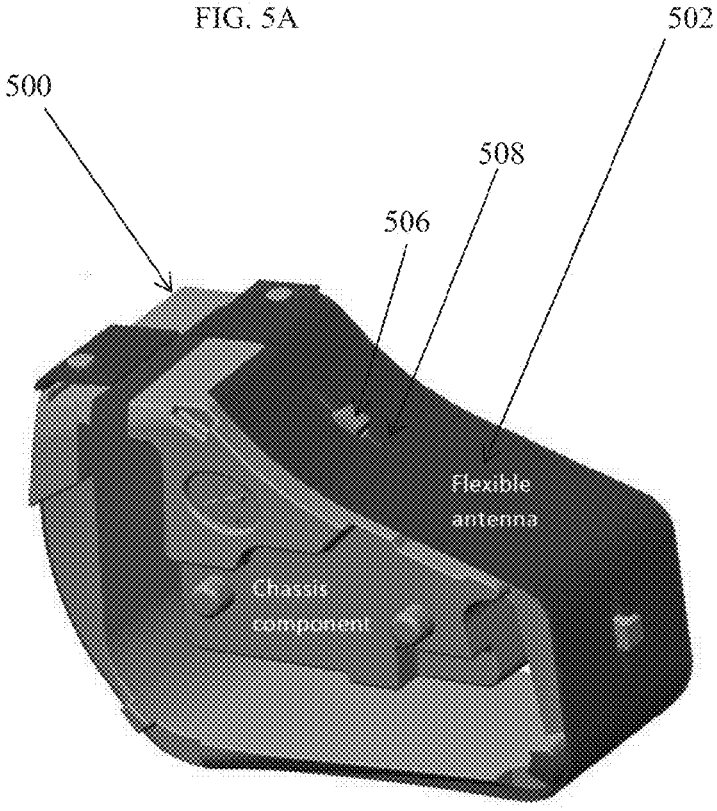
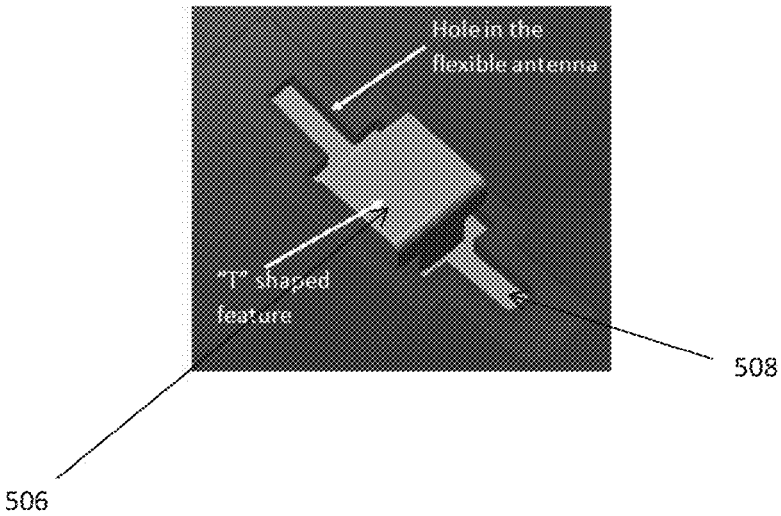
FIG. 5B

SYSTEMS AND METHODS FOR HEARING ASSISTANCE DEVICE ANTENNA

CLAIM OF PRIORITY AND INCORPORATION BY REFERENCE

The present application claims the benefit under 35 U.S.C. §119(e) of U.S. Provisional Application 61/927,685, filed Jan. 15, 2014, the disclosure of which is hereby incorporated by reference herein in its entirety.

TECHNICAL FIELD

This document relates generally to hearing assistance systems and more particularly to methods and apparatus for a hearing assistance device antenna.

BACKGROUND

Modern hearing assistance devices, such as hearing aids, are electronic instruments worn in or around the ear that compensate for hearing losses of hearing-impaired people by specially amplifying sounds. The sounds may be detected from a patient's environment using a microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and are easy to maintain. The hearing aids may each include an antenna for the wireless communication. Assembling a loop antenna into a hearing aid can by difficult due to tooling constraints.

Accordingly, there is a need in the art for improved systems and methods for hearing assistance device antennas.

SUMMARY

Disclosed herein, among other things, are systems and methods for a hearing assistance device antenna. One aspect of the present subject matter includes a universal apparatus for use with multiple hearing assistance devices. The apparatus includes a circuit module including an outer radial surface, the circuit module configured to provide electronics for a hearing assistance device. A flex circuit loop antenna is configured to be affixed to the outer radial surface, and the antenna is configured for wireless communication for the hearing assistance device. After the antenna is affixed to the outer radial surface, the circuit module is configured to be inserted into a plurality of different main hearing assistance device chassis, in various embodiments. According to an embodiment, the circuit module includes a t-shaped protrusion and the antenna includes an opening configured to align with and receive the t-shaped protrusion to affix the antenna to the circuit module. In various embodiments, the antenna is spaced from the module or spine to improve antenna performance. In various embodiments, the antenna includes bend-relief cutouts configured to allow the antenna to follow the contour of the outer radial surface without kinking.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

FIG. 5A illustrates a side view showing an opening in the flex antenna secured over a retention feature of the modular component, according to various embodiments of the present subject matter.

FIG. 5B illustrates a close up view of FIG. 5A showing the opening in the flex antenna secured over the retention feature of the modular component, according to various embodiments of the present subject matter.

DETAILED DESCRIPTION

Figure 1:
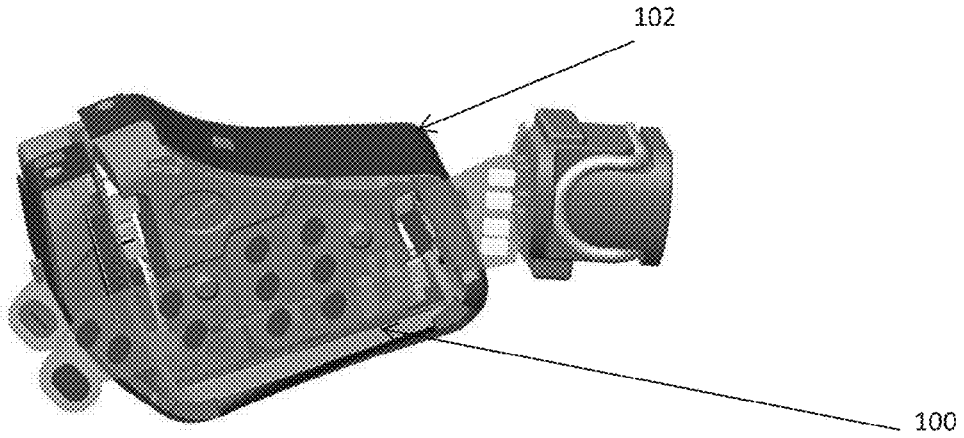
FIG. 1 illustrates a side view of a modular component with a flex antenna for a hearing assistance device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Utilizing a loop antenna in a hearing aid offers significant benefits in 900 MHz wireless performance. Currently, assembling the antenna along with the integrated circuit (IC) into a chassis (or spine) is difficult because of tooling constraints. In addition, it is difficult to consistently mold a long thin cavity feature in a plastic part. Presently, the flex-based antennas are assembled into hearing aids using solder, adhesive and locating features. "Into the hearing aid" refers to inside the hearing aid outer cosmetic case, often times onto a supporting chassis that is assembled into the cosmetic case. The solder is used to make an electrical connection. Adhesive adds time-consuming steps to the manufacturing process and allows for increased variability in the placement of the antenna. Adhesive also makes repair more difficult, because of the risk of permanent damage to the antenna or chassis that have been glued together. Presently-used locating posts are ineffective at holding down the antenna without glue. Also if designed for a compression fit, a post will run the risk of damaging the antenna by tearing or ripping the substrate. Previous methods have used butterfly shaped antennas that wrap around the device or coil antennas. However, a butterfly shaped antenna is more difficult to assemble and suffers from poor performance relative to a loop shaped antenna, and a coil antenna is designed to work at different wireless frequencies which require accessory devices to stream audio from a source to the hearing aid.

The present subject matter uses two parts to allow a flex loop antenna to be correctly and consistently located within the main hearing assistance device chassis. In addition the present subject matter uses a modular circuit module including the ICs and the antenna that can be used in numerous different hearing assistance device configurations and applications.

Disclosed herein, among other things, are systems and methods for modular circuit component for a hearing assistance device flex antenna. One aspect of the present subject matter includes a universal apparatus for use with multiple hearing assistance devices. The apparatus includes a circuit module including an outer radial surface, the circuit module configured to provide electronics for a hearing assistance device. In various embodiments, the outer surface has different shapes, rounded or not rounded or a combination of the two, without departing from the scope of the present subject matter. A flex circuit loop antenna is configured to be affixed to the outer radial surface, and the antenna is configured for wireless communication for the hearing assistance device. After the antenna is affixed to the outer radial surface, the circuit module is configured to be inserted into a plurality of different main hearing assistance device chassis, in various embodiments. Thus, the same circuit module can be used in behind-the-ear, in-the-ear, in-the-canal, or any other type of hearing assistance device, in various embodiments. This modular approach reduces design and manufacturing costs and provides for repeatable antenna placement in the main hearing assistance device chassis. In various embodiments, the module snaps into the chassis. Other methods for retaining the module in the chassis can be used without departing from the scope of the present subject matter. According to an embodiment, the circuit module includes a retention feature and the antenna includes an opening configured to align with and receive the retention feature to affix the antenna to the circuit module. In one embodiment, the retention feature includes a t-shaped protrusion.

In various embodiments, the present subject matter uses two parts, a circuit module and an antenna, to allow the loop antenna to be correctly and consistently located in the hearing assistance device chassis, while still being easily manufactured and assembled. In addition, the present subject matter uses a modular circuit module, or component, that includes the hearing assistance ICs and the antenna and that can be reused in numerous different hearing assistance device applications. The present subject matter provides a moldable means to hold a loop antenna into a hearing aid chassis, and allows for a modular assembly approach to the antenna and circuit that can be reused in numerous hearing aid sizes and shapes. In addition the present subject matter eliminates the need to use an adhesive and also provides an effective means to align the antenna within the assembly. The present subject matter provides for splitting up a single, complex, difficult to (plastic injection) mold and difficult to assemble chassis into two simple to mold, easy to assemble portions. In various embodiments, the circuit module with affixed flex antenna is inserted into the main hearing aid chassis. The circuit module can friction-fit or snap-fit into the main hearing aid chassis, in various embodiments. This eliminates a deep draw in a mold which does not consistently run, and also provides for a simple final assembly method. The circuit module includes a bobbin shape, in an embodiment. Other module shapes can be used without departing from the scope of the present subject matter. In various embodiments, the flex antenna is fitted around the module using a vertical loop. Other antenna shapes can be used without departing from the scope of the present subject matter.

In addition, the present subject matter eliminates the need to use an adhesive and also provides an effective way to align the antenna within the assembly. The geometry of the module holding features and the associated holes in the flex antenna are configured to fit to hold the antenna to the module. In the module component a "T" shaped feature secures the antenna, in an embodiment, and the antenna is designed to allow it to easily snap over the "T" shaped feature. Other shapes, besides the T-shape, can be used for the feature (or protrusion) and for the corresponding hole in the antenna without departing from the scope of the present subject matter. Thus, the present subject matter simplifies manufacturing and allows for increased wireless performance, and uses a unique holding feature shape that is effective at securely holding the flexible antenna in a consistent and repeatable location. This provides for a more consistent wireless response and link budget, in various embodiments. In various embodiments, the module of the present subject matter is used to insert electromagnetic shielding into the hearing assistance device chassis, instead of or in addition to the flex antenna. Other type of antennas, besides flex antennas, can also be used without departing from the scope of the present subject matter.

In various embodiments of the present subject matter, the antenna is spaced from the module or spine to improve antenna performance. The antenna spacing can be used with or without the modular component, such as with a hearing aid spine. In one embodiment, an air gap is provided between the antenna and the circuit module configured to reduce effective dielectric constant to maximize physical aperture for a desired electrical length. In various embodiments, ribs in the spine (or the component) create air gaps or spaces between the plastic of the supporting spine/component and the antenna. The air gaps reduce the effective dielectric constant, allowing the structure to be physically longer for the same electrical length. Thus, antenna gain and radiation efficiency are improved, directivity is increased and loss is decreased. The net is an overall improvement in antenna performance. The use of plastic ribs on the spine or component (or molded into the spine or component) creates an air gap for longer electrical length in a smaller physical space. In various embodiments, a foam spacer can be used to create the gaps/spaces between the spine/component and the antenna. Other types of spacers can be used without departing from the scope of the present subject matter. In various embodiments, a plastic rib structure minimizes dielectric loading and eliminates the added labor and material costs of using tape. In various embodiments, the ribs are placed to minimize near-contact area with the antenna conductor (i.e., by using orthogonal crossings instead of parallel) while still providing adequate mechanical support for the antenna. This placement lowers refraction and coupling of the antenna. Additional benefits of an air (or air-like) gap, beyond allowing a larger physical aperture for a given electrical length, include reduced dielectric loading (loss) and coupling to other dielectrics. In various embodiments, the air gap is maximized. Other sizes of air gaps can be used without departing from the scope of the present subject matter. In various embodiments, the air gap distances between the antenna and the spine are uniform. In other embodiments, a variety of air gap distances can be used. The plastic of the spine/component predominantly refracts the wave from the antenna, as in a lens, since a wavelength in the plastic is physically shorter than it is in air, thus increasing loss.

Figure 2:
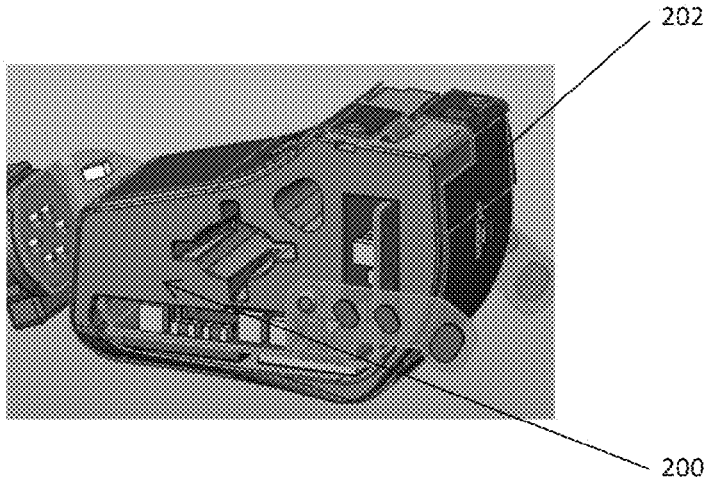
FIG. 2 illustrates a further side view of a modular component with a flex antenna for a hearing assistance device, according to various embodiments of the present subject matter.

FIG. 1 illustrates a side view of a modular component with a flex antenna for a hearing assistance device, according to various embodiments of the present subject matter. The apparatus includes a circuit module 100 including an outer radial surface, the circuit module configured to provide electronics for a hearing assistance device. A flex circuit loop antenna 102 is configured to be affixed to the outer radial surface, and the antenna is configured for wireless communication for the hearing assistance device. FIG. 2 illustrates a further side view of a modular component with a flex antenna for a hearing assistance device, according to various embodiments of the present subject matter. The apparatus includes a circuit module 200 including an outer radial surface, the circuit module configured to provide electronics for a hearing assistance device. A flex circuit loop antenna 202 is configured to be affixed to the outer radial surface, and the antenna is configured for wireless communication for the hearing assistance device.

Figure 3:
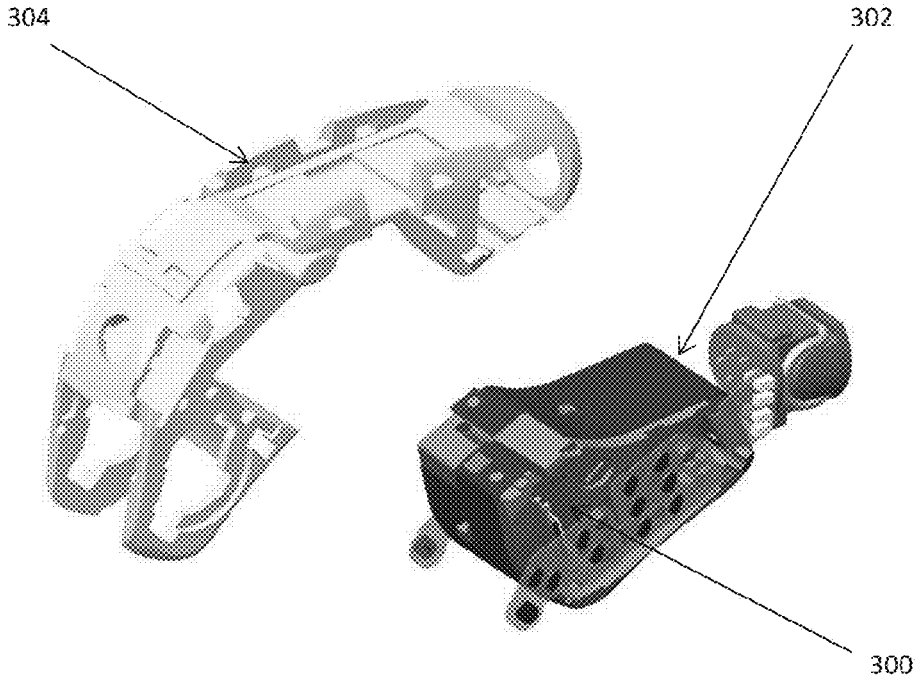
FIG. 3 illustrates the modular component and flex antenna of FIG. 1 before insertion into a main hearing assistance device chassis, according to various embodiments of the present subject matter.
Figure 4:
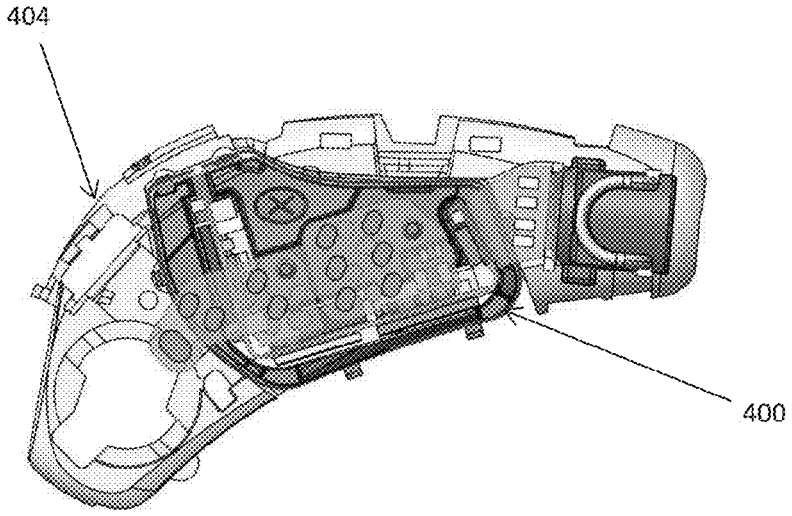
FIG. 4 illustrates the modular component and flex antenna of FIG. 1 after insertion into a main hearing assistance device chassis, according to various embodiments of the present subject matter.

FIG. 3 illustrates the modular component 300 and flex antenna 302 of FIG. 1 before insertion into a main hearing assistance device chassis 304, according to various embodiments of the present subject matter. FIG. 4 illustrates the modular component 400 and flex antenna of FIG. 1 after insertion into a main hearing assistance device chassis 404, according to various embodiments of the present subject matter. FIG. 5A illustrates a side view showing an opening 508 in the flex antenna 502 secured over a retention feature 506 of the modular component 500, according to various embodiments of the present subject matter. FIG. 5B illustrates a close up view of FIG. 5A showing the opening 508 in the flex antenna secured over the retention feature 506 of the modular component, according to various embodiments of the present subject matter.

Figure 6A:
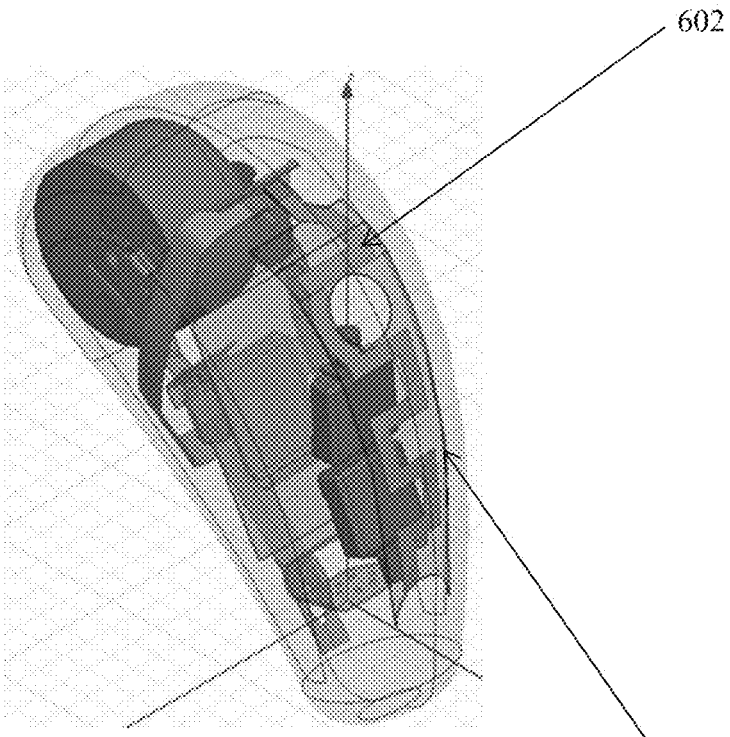
FIG. 6A illustrates a hearing assistance device with an air gap between the antenna and the spine, according to various embodiments of the present subject matter.
Figure 6B:
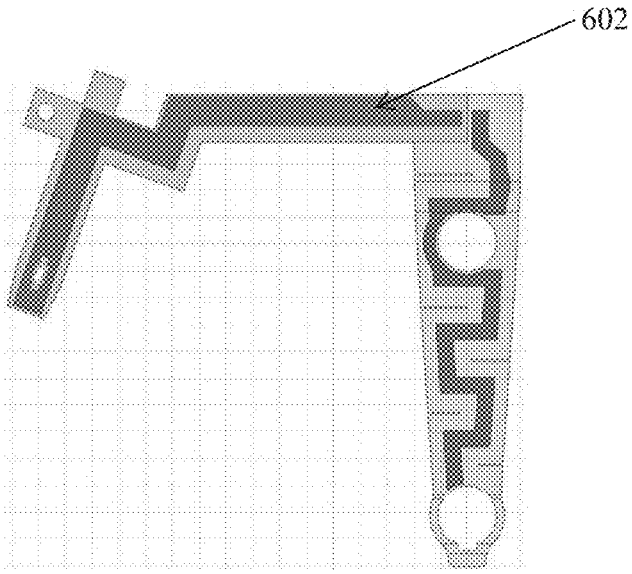
FIG. 6B illustrates the antenna of FIG. 6A configured to provide an air gap between the antenna and the spine, according to various embodiments of the present subject matter.

FIG. 6A illustrates a hearing assistance device with an air gap between the antenna 602 and the spine 600, according to various embodiments of the present subject matter. FIG. 6B illustrates the antenna 602 of FIG. 6A configured to provide an air gap between the antenna and the spine, according to various embodiments of the present subject matter.

In various embodiments, the present subject matter achieves desired antenna gain and radiation efficiency in a small form factor. Previously, antennae in hearing aids were tightly coupled to the hearing aid battery. However, this results in increased losses and coupling. The present subject matter routes the antenna to minimize coupling to the battery and reduces hearing aid thickness and improves antenna performance by reducing coupling to battery and head tissue. Various embodiments of the present subject matter provide for a collapsed dipole antenna with balanced input selected, and more consistent performance is provided by changing spacing between antenna and head tissue. In various embodiments, the antenna dipoles arms/traces are folded, to maximize aperture without increasing case size, to transmit and receive multiple polarizations, and to support multiple use cases. In some embodiments, the antenna is fed from a centerline of the hearing aid, to provide symmetry to reduce left-right performance differences and to improve isotropic field pattern for each leg of the antenna. In various embodiments, a top dipole arm of the antenna is centered. In further embodiments, the dipole is offset from an edge of the hearing aid to reduce head loading while maintaining a large aperture and supporting multiple antenna polarizations. In still further embodiments, the antenna is meandered (see FIG. 6B, for example), to accommodate top microphone ports and cover, and to provide a desired combination of electrical length and physical length. In various embodiments, a side-bottom dipole includes a folded conductor arm. In one example, the conductor arm is directed away from the top arm at a feed point to maximize effective antenna aperture. In various embodiments, the folded conductor arm is substantially orthogonal to the top arm to support multiple polarizations. In one embodiment, the conductor arm is directed in front of battery, to allow for a thinner hearing aid case. The present subject matter provides for decoupling the antenna from the battery to improve average antenna performance without increasing hearing aid width. All of the described antenna embodiments can be implemented with a flex antenna, or other type of antenna, without departing from the scope of the present subject matter.

Figure 7:
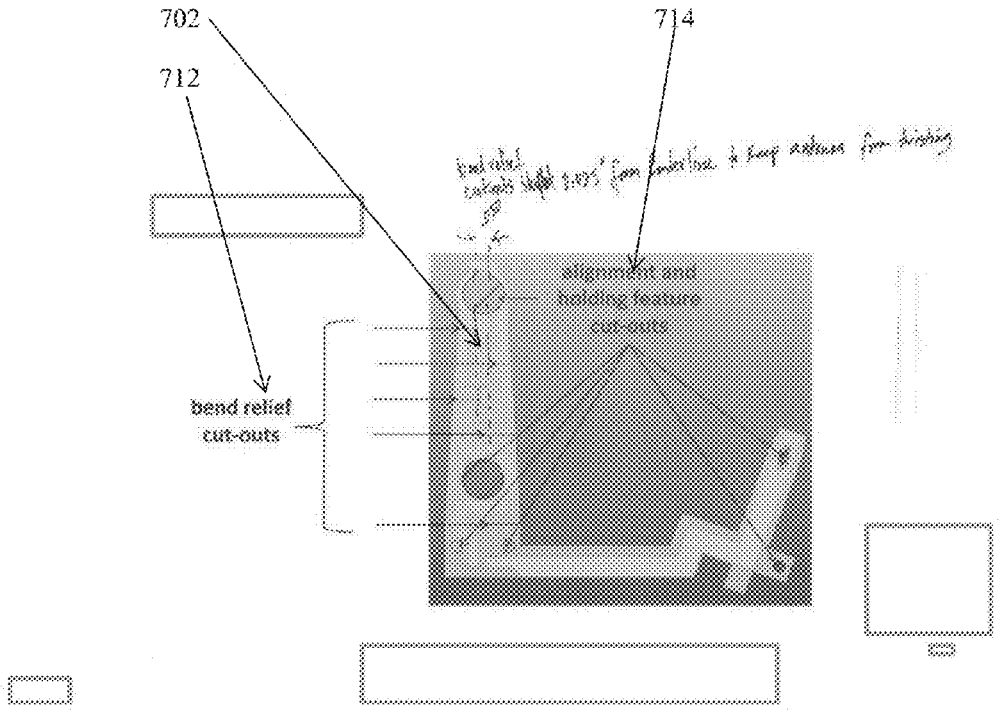
FIG. 7 illustrates an antenna and support structure including bend-relief cutouts, according to various embodiments of the present subject matter.

In various embodiments, the antenna includes bend-relief cutouts configured to allow the antenna to follow the contour of the outer radial surface without kinking The bend-relief cutouts can be used with or without the modular component, such as with a hearing aid spine. FIG. 7 illustrates an antenna 702 and support structure including bend-relief cutouts 712, according to various embodiments of the present subject matter. The depicted embodiment further includes alignment and hold feature cutouts 714. In various embodiments, including bend-relief cutouts in the top antenna leg flex allows the flex to more easily follow the contour of the spine without kinking. In addition, this reduces the likelihood of delamination and provides for increased ease of assembly.

Various embodiments of the present subject matter support wireless communications with a hearing assistance device. In various embodiments the wireless communications can include standard or nonstandard communications.

Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), invisible-in-canal (IIC) or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus, comprising:

a circuit module including an outer radial surface, the circuit module configured to provide electronics for a hearing assistance device; and a flex circuit loop antenna configured to be affixed to and conform to a portion of the outer radial surface, the antenna configured for wireless communication for the hearing assistance device, wherein, after the antenna is affixed to the outer radial surface, the circuit module is configured to be fitted into a plurality of different main hearing assistance device chassis, wherein the circuit module includes a t-shaped protrusion and the antenna includes an opening configured to align with and receive the t-shaped protrusion to affix the antenna to the circuit module.

2. The apparatus of claim 1, wherein the antenna includes bend-relief cutouts configured to allow the antenna to follow the contour of the outer radial surface without kinking.

3. The apparatus of claim 1, wherein the circuit module is configured to be snapped into the hearing assistance device chassis.

4. The apparatus of claim 1, wherein at least one of the hearing assistance device chassis includes a chassis for a cochlear implant.

5. The apparatus of claim 1, wherein at least one of the hearing assistance device chassis includes a chassis for a hearing aid.

6. The apparatus of claim 5, wherein the hearing aid includes an in-the-ear (ITE) hearing aid.

7. The apparatus of claim 5, wherein the hearing aid includes a behind-the-ear (BTE) hearing aid.

8. The apparatus of claim 5, wherein the hearing aid includes an in-the-canal (ITC) hearing aid.

9. The apparatus of claim 5, wherein the hearing aid includes a receiver-in-canal (RIC) hearing aid.

10. The apparatus of claim 5, wherein the hearing aid includes a completely-in-the-canal (CIC) hearing aid.

11. The apparatus of claim 5, wherein the hearing aid includes a receiver-in-the-ear (RITE) hearing aid.

12. A method, comprising:

providing a circuit module including an outer radial surface, the circuit module configured to provide electronics for a hearing assistance device; and affixing a flex circuit loop antenna to a portion of the outer radial surface, the antenna conforming, to a portion of the outer radial surface and configured for wireless communication for the hearing assistance device, after the antenna is affixed to the outer radial surface, inserting the circuit module into a main hearing assistance device chassis using a fitted connection, wherein the antenna is configured to be inserted into a plurality of different main hearing assistance device chassis, wherein the circuit module includes a t-shaped protrusion and the antenna includes an opening configured to align with and receive the t-shaped protrusion to affix the antenna to the circuit module.

13. The method of claim 12, wherein the antenna includes bend-relief cutouts configured to allow the antenna to follow the contour of the outer radial surface without kinking.

14. The method of claim 12, wherein the circuit module is configured to be snapped into the hearing assistance device chassis.

15. The method of claim 12, wherein the circuit module is configured to be friction fit into the hearing assistance device chassis.

16. The method of claim 12, wherein the flex antenna is configured to be fitted around the module using a vertical loop.

* * * * *